United States Patent [19]

Pittie et al.

[11] 4,073,709

[45] Feb. 14, 1978

[54] ELECTROLYTIC RECOVERY OF NICKEL AND ZINC

[75] Inventors: Willem Hubert Pittie, Rooderpoort, Transvaal; Gerhardus Overbeek, Florida, Transvaal, both of South Africa

[73] Assignee: Anglo-Transvaal Consolidated Investment Company Limited, Johannesburg, South Africa

[21] Appl. No.: 609,812

[22] Filed: Sept. 2, 1975

[30] Foreign Application Priority Data

Sept. 4, 1974 South Africa ..... 74/5625

[51] Int. Cl.[2] ..... C25C 1/08; C25C 1/16

[52] U.S. Cl. ..... 204/113; 204/118

[58] Field of Search ..... 204/113, 118, 263

[56] References Cited

U.S. PATENT DOCUMENTS 1,980,381 11/1934 Cain ..... 204/113

2,480,771 8/1949 Renzoni ..... 204/263

3,072,545 1/1963 Juda et al. ..... 204/113

*Primary Examiner*—R. L. Andrews

*Attorney, Agent, or Firm*—Cushman, Darby & Cushman

[57] ABSTRACT

An electrolyte process for the recovery of nickel or zinc from solutions wherein the anions are substantially purely chloride comprises introducing the solution into a cathode compartment of an electrolytic cell which is divided into three compartments namely an anode compartment, a cathode compartment, and an electrolyte compartment therebetween, the anode compartment being defined by a porous diaphragm of low permeability which separates the anolyte from the electrolyte, the anolyte comprising a solution containing anions which have an oxidation potential sufficiently high to ensure that substantially only the decomposition of water takes place at the anode under operating conditions and wherein the cathode compartment is defined by a diaphragm of relatively high permeability.

9 Claims, 2 Drawing Figures

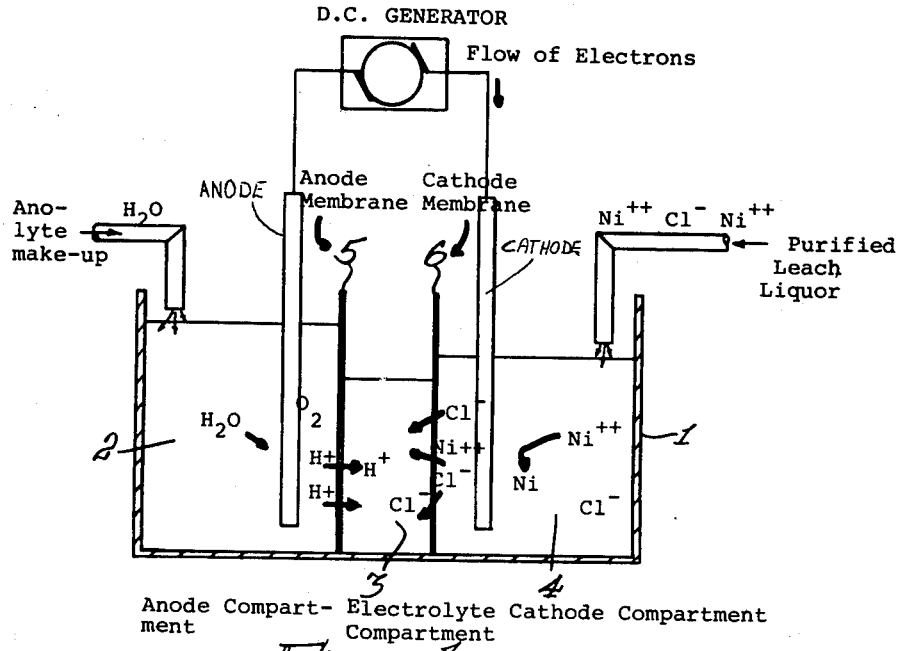
Fig 1.
Fig 2.
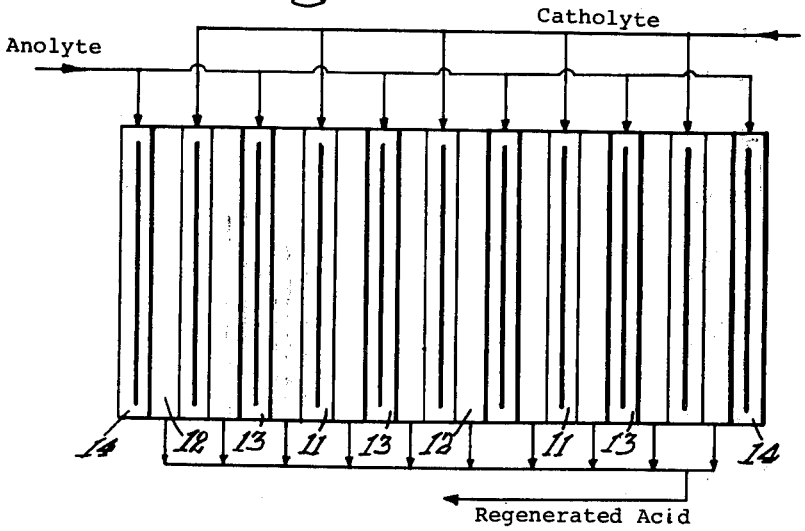

ELECTROLYTIC RECOVERY OF NICKEL AND ZINC

BACKGROUND OF THE INVENTION

This invention relates to the electrolytic recovery of nickel and zinc from solutions thereof such as in conventional electrowinning processes.

In such electrolytic processes the solution from which the metal is recovered generally includes the anions of the acid used to leach the metals into solution and in order to provide an economic process this acid is preferably, if not of necessity, regenerated in the electrolytic cell. In order for this to be achieved the oxidation potential of the said anions should be higher than the decomposition potential of water at normal operating conditions in order to avoid oxidation of the anions and thus destruction of the capability of regenerate the leaching acid.

It is for the above reason that nickel and zinc are generally leached using sulphuric acid since the sulphate ion has a high oxidation potential and thus the hydrolysis of water takes place at the anode in preference to the oxidation of the sulphate ions.

It has long been recognized from the general theoretical point of view that hydrochloric acid has more desirable properties in particular higher conductivity but the chloride anion would, in a conventional electrolytic cell be lost as a result of being oxidized to form chlorine gas at the anode. Thus, the process would be uneconomical in view of the high cost of hydrochloric acid quite apart from the dificulties created by the chlorine gas evolved at the anode.

The latter problems are clearly indicated in U.S. Pat. Nos. 2,578,839 and 2,480,771 to Renzoni wherein a special three compartment type of cell is provided simply to enable sulphate type of electrolytes containing relatively small amounts of chloride ions to be electrolized to recover nickel. These patents disclose cells wherein distinct anode compartments and cathode compartments are separated by middle compartments. In each case the compartments are defined by fabric type diaphragms and sulphuric acid anolyte is induced by means of a suitable head, to flow through the diaphragms defining the anode compartments into the middle compartments to prevent chloride ions reaching the anodes. Since these cells regenerate sulphuric acid the flow of anolyte through the diaphragm does not affect the re-usable characteristics of the spent electrolyte which is basically sulphate in nature. These patents further illustrate the high power consumption associated with a sulphate system — the FIGURES being given in the preferred example as 6.5 volts to produce a current density of 0.033 amperes per square centimeter. Owing to the permeable nature of the diaphragms used to define the anode compartments such cell would be valueless in the electrolytic recovery of nickel from substantially pure chloride solutions owing to contamination of the regenerated acid with sulphuric acid from the anode compartments.

On the other hand, whilst not relating to the recovery of nickel or zinc, U.S. Pat. No. 3,072,545 to Juda et al. describes a similar cell for use in regenerating spent pickle liquors and wherein the separate anode compartment is utilized to prevent the oxidation of oxidizable cations at the anode. In this case the anode compartments are defined by ion exchange diaphragms which positively prevent the flow of anolyte through the diaphragms. Such a cell is also unapplicable to the economic recovery of metals since the ion exchange diaphragms exhibit high electrical resistance with a corresponding high power consumption.

SUMMARY OF THE INVENTION

It is the object of this invention to provide a method and electrolytic cell which will enable nickel and zinc to be recovered economically from chloride leach solutions thereof.

In accordance with this invention there is provided a method of electrolytically recovering nickel and zinc from solutions thereof wherein the anions are substantially purely chloride comprising introducing the solution into a cathode compartment of an electrolytic cell which is divided into three compartments namely an anode compartment, a cathode compartment and an electrolyte compartment therebetween, the anode compartment being defined by a porous membrane of low permeability which separates the anolyte from the electrolyte; the anolyte comprising a solution containing anions which have an oxidation potential sufficiently high to ensure that substantially only the decompositin of water takes place at the anode under operating conditions, and wherein the cathode compartment is defined by a diaphragm of relatively high permeability.

Further features of the invention provide for the liquid level in the anode compartment to be higher than that in the adjacent electrolyte compartment in order to inhibit flow of electrolyte into the anode compartment, for make up solution to be fed to the anode compartment during operation of the cell and for regenerated acid to be withdrawn from the electrolyte compartment.

The liquid level in the anode compartment is maintained only at a reasonable height above the liquid in the electrolyte compartment to avoid appreciable pressure urging a flow of anolyte (which is preferably sulphuric acid) into the electrolyte compartment since such flow contaminates the regenerated hydrochloric acid. Also, it is preferable that the specifc gravity of the anolyte be matched as closely as possible to that of the electrolyte to avoid differing pressures being exerted on the diaphragm defining the anode compartment according to depth. To this end sulphuric acid is well suited in view of the fact that solutins thereof in water can be made to have a large variety of specific gravities depending upon the concentration of the acid solution.

Since a low permeability porous diaphragm is nevertheless permeable to a certain extent, small amounts of chloride ions will leak into the anode compartment. In order to avoid the oxidation of such chloride ions to chlorine gas a small amount of a soluble compound is included in the anolyte, the compound being chosen to form a precipitate upon reaction with the chloride ion. In the case of sulphuric acid being used as the anolyte, silver sulphate may be used for the purpose since the resultant silver chloride precipitate is highly insoluble.

The diaphragm defining the anode compartment preferably has a high porosity balanced with as low a permeability as possible. We have found that certain unglazed clay tiles or sheets having the necessary chemical resistance to the conditions in the cell are well suited for the purpose. In particular, it is possible to produce such tiles or sheets having a porosity of 30% whilst fulfilling the requirement of low permeability. Such tiles or sheets will be more fully described hereinafter. It will be understood that the reaction taking place the anode will be decomposition of water rather than the oxidation of any anion present as such and that the hydrogen ions formed must be able to migrate through the porous diaphragm or pass therethrough according to the Grotthus mechanism as the case may be. Such diaphragms have further been found to have an acceptibly low electrical resistance which is desirable.

The diaphragm defining the cathode compartment is simply a conventional fairly permeable diaphragm such as a woven fabric or the like.

The hydrogen ions present in the electrolyte compartment are believed to complex with water to form hydronium ions which migrate towards the cathode according to the Grotthus mechanism. This means that their mobility is greater than that of chloride ions, for example, and there will tend to be a net movement of hydrogen ions towards the cathode. In order to prevent this, the level of catholyte in the cathode compartment is maintained at a predetermined height above that of the electrolyte so that there will be a positive flow of liquid through the cathode diaphragm at a rate greater than the rate of migration of the hydrogen ions towards the cathode. Thus the feed of fresh leach liquor is regulated to maintain the "head" in the cathode compartment.

As chloride solutions are better conductors of electricity than sulphate solutions (which are generally used for recovering nickel and zinc) we have found that, firstly, metals can be recovered more economically from chloride solutions and, secondly, metals can be deposited at a faster rate (i.e., at higher current densities) than is possible with sulphate solutions prior to the evolution of hydrogen at the cathode.

The reaction which takes place at the cathode is the same under normal operating conditions regardless of which anion is present in the feed solution this reaction simply being the reduction of the nickel ions to leave metallic nickel deposited on the electrode.

The reaction at the anode of the cell can be either or both of two reactions, namely, the hydrolysis of water and the oxidation of the anion. In the case of a sulphate anion only the hydrolysis of water takes place (standard potential of plus 1,23 volts) since the oxidation potential of the sulphate ion is much higher. The nickel sulphate cell is generally operated at about 3.5–3.8 volts.

Therefore where a nickel chloride solution is used in accordance with this invention the anion in the anode compartment must be chosen bearing this in mind.

Further considerations to be borne in mind when selecting the anolyte are the following:

The compound must have a conductivity similar to or greater than that of the electrolyte, failing which the economic advantage (power consumption) using chloride solutions would be lost. The anion of the anolyte must have an oxidation potential well in excess of the decomposition potential of water.

Some anolyte will always leak into the electrolyte compartment and, if, as usual, spent electrolyte is to be used for recirculation to the leaching circuit it follows that the anolyte must either be a compound which does not interfere with the leaching, or that it must be a compound which can be easily removed.

BRIEF DESCRIPTION OF THE DRAWINGS

FIG. 1 illustrates schematically a test cell used for conducting practical tests according to the invention, and FIG. 2 illustrates schematically an industrial cell to which the present invention may be applied.

DESCRIPTION OF THE PREFERRED EMBODIMENTS OF THE INVENTION

In the preferred method of implementing the invention the diaphragm used for defining the anode compartment was produced as outlined below.

The diaphragm was made from a clay found in the Broederstroom area in the Republic of South Africa. The clay was initially leach with 100 g/l HCl in an amount of 200ccs acid per 100g clay. The leach was conducted by boiling under reflux for 24 hours. This resulted in a weight loss of 20% and the change in analysis is shown in Table I. This treatment was effected to remove non acid resisting clay and iron.

24g of the treated hydrous aluminum silicate clay having the composition given in table I and 27 g of cane sugar were mixed thoroughly and milled to 100% - 325 mesh.

TABLE I

ANALYSIS OF THE DIAPHRAGM MATERIAL (HYDROUS ALUMINIUM SILICATE)

| Constituent | Before acid Treatment % | After Acid Treatment % |
|---|---|---|
| $Al_2O_3$ | 36.0 | 27.6 |
| $SiO_2$ | 48.0 | 55.7 |
| FeO | 9.6 | 1.0 |
| Loss on ignition | 7.2 | 6.0 |

The powdered mixture was then placed in a die, the dimensions of which were 8 × 15 × 15cm wherein the 8cm defined the depth of the die.

The powder was then compressed by means of a hydraulic press to a thickness of 0.6cm, under a pressure of 250 atm. (i.e., 250 kg/cm$^2$). The compressed material was then removed from the die and ignited at 1000° C for 24 hours. The physical properties of the clay diaphragm plate were then determined and the porosity found to be 30% and the permeability of normal pressure was 0.01 ml/hr/cm$^2$.

TABLE 2

| | |
|---|---|
| Porosity | 30% |
| Permeability | 0.01 ml/hr/cm$^2$ |

By using higher temperatures of ignition it was found that the porosity decreased and permeability decreased accordingly. From this it would appear that a tile of suitable porosity and permeability could be produced from a wide variety of clays and a suitable temperature of ignition chosen However, the electrical resistance increased to undesirable extent.

Chemical tests on the tiles revealed that 50% w/v of sulphuric acid at 60° C produced an effective wear on the tile at an equivalent rate of 0.6mm/year whilst a 10% w/v HCl solution at the same temperature produced effective wear at the equivalent rate of 0.5mm/year. These FIGURES were calculated from the weight loss over a period of 1 month. Thus the chemical resistance of the tiles was considered satisfactory.

The desired diaphragm area was then obtained by placing as many tiles as may be required in a window-type frame work and by fixing the tiles in position by means of a chemically resistant ceramic cement, which is obtainable commercially.

Experimental tests using a cell as depicted in FIG. 1 were obtained, the apparatus used comprising a container 1, divided into three compartments, 2, 3, 4. The compartment 2 housing the anode was defined using the clay tiles as the diaphragm 5 whilst that defining the cathode compartment 4 was a conventional diaphragm 6 of woven or other permeable construction. A leach solution of nickel chloride containing 75g/l of nickel 55g/l sodium chloride and 10g/l boric acid was fed to the cathode compartment to maintain the liquid level therein at a desired height above that in the electrolyte compartment 3 in order to maintain a desired flow rate through the diaphragm 6 for the purposes set hereinbefore. A flow rate was selected by trial and error procedures such that the nickel concentration in the electrolyte was reduced to 50g/l. This solution flows into the cathode compartment, through the diaphragm, and out from the central or electrolyte compartment.

The liquid level in the anode compartment was maintained as above described with a 34% sulphuric acid solution as the specific gravity of this solution was substantially identical to that of the electrolyte.

In order to prevent the small amount of chlorine ions leaking through the anode diaphragm from becoming oxidized to chlorine gas 4g of $Ag_2SO_4$/liter are introduced into the anolyte to ensure precipitation of the chloride as silver chloride.

The current efficiency at the above flow rate was in excess of 95% when the cell was operated at 60° C. Compared to conventional sulphate solutions where the limiting current density is of the order of 0.02 amps/cm$^2$ no detectable drop in current efficiencies has been observed when nickel is deposited from chloride solutions at current densities in excess of 0.04 amps/cm$^2$ of cathode.

In the case of the sulphuric acid anolyte described 2.7 volts was required to produce a current density of 0.02 amps/cm$^2$ whilst 3.0 volts were required to produce a current density of 0.04 amps/cm$^2$. The leakage of $CL^{31}$ -ions was found to be 0.4 based on the regenerated acid and calculated from the total weight of silver chloride formed over a specific period.

The concentration of hydrochloric acid regenerated by the electrolysis was found to be of the order of 30g/1.

The advantage of using a chloride system and thus a hydrochloric acid leach are believed to be as follows.

Firstly, as the reactivity of hydrochloric acid is greater than that of sulphuric acid, it is generally hydrochloric acid which is preferred for leaching reactions. This is particularly true for certain South African nickel-copper matte leaching where a nickel extraction in excess of 90% can be obtained with the stoichiometric quantity of HCl. Under similar leaching conditions at least 100% excess of $H_2SO_4$ is required to achieve this.

Secondly, as nickel can be deposited at lower potentials from chloride solutions, it follows that at a given current density the electrowinning of nickel from chloride solutions will be more economical (lower KWH per unit of nickel), and/or since the limiting current density for chloride solutions is higher, the size of the electrowinning plant required for chlorides will be smaller than that for sulphates at a given potential.

It will be appreciated that the technique as described above for nickel chloride, can also be applied to recover zinc from zinc chloride solutions.

A test conducted for zinc chloride on the above described cell yielded the following results:

In this particular case the feed solution to the cathode compartment consisted of 55 g/l Zinc as the chloride 30 g/l of free hydrochloric acid, 50 g/l of sodium chloride and 10 g/l boric acid. (Since the overpotential of hydrogen on zinc is much higher than on nickel, a certain amount of free acid can be tolerated in the cathode compartment.)

The flow rate of the feed to the cathode compartment was so adjusted that the zinc concentration in the electrolyte was reduced to 23 g/l. The cell was operated at a temperature of 40° C.

The current efficiency at the above flow rate was in excess of 92% compared to current efficiencies of 82.5 normally obtained from sulphate solutions under similar conditions (i.e., concentration of free acid).

The potential required to obtain a current density of 0.045 amps/cm$^2$ was found to be 2.6 volts compared to the 3.45 volts required to obtain a current density of 0.45 amps/cm$^2$ for sulphate solutions under similar conditions.

No difficulties should be encountered by utilizing a large number of cells in juxtaposed relationship as is usual in the art of electrolysis. In such a case, as illustrated in FIG. 2 each cathode compartment 11 has an electrolyte compartment 12 on each side thereof and similarly each anode compartment 13 has an electrolyte compartment on each side thereof apart from those 14 located at each end of the composite cell.

It is to be noted that existing electrolysis plants can easily be adapted to operate in accordance with this invention the alterations necessary being easily apparent to those skilled in the art in the light of the disclosure above.

We claim:

1. A method for electrolytically recovering a metal selected from the group consisting of nickel and zinc from a solution containing nickel or zinc ions and anions, wherein the anions are substantially purely chloride, comprising:

introducing the solution into a cathode containing compartment of an electrolytic cell which is divided into three compartments, namely an anode containing compartment, a cathode containing compartment, and an electrolyte compartment therebetween, the anode containing compartment being defined by a porous aluminum silicate diaphragm of low permeability to substantially inhibit migration of chloride ions into the anode containing compartment and which separates anolyte from electrolyte, the anolyte comprising a solution containing anions which have an oxidation potential sufficiently high to ensure that substantially only the decomposition of water takes place at the anode under operating conditions and wherein the cathode containing compartment is defined by a diaphragm of relatively high permeability, and applying an electrical potential to said anode and cathode to cause migration and deposition of said metal at said cathode, to cause hydrogen ions to migrate through the porous aluminium silicate diaphragm by the Grotthus mechanism, and decomposition of water at said anode.

2. A method as claimed in claim 1 in which a substance is included in the anolyte, the substance being chosen to combine with chloride ions entering the anode compartment to prevent oxidation of chloride ions at the anode.

3. A method as claimed in claim 2 in which the substance is a suitable soluble silver salt.

4. A method as claimed in claim 1 in which the liquid level in the anode containing compartment is maintained at a higher level than that in the adjacent electrolyte compartment.

5. A method as claimed in claim 1 in which make-up anolyte is fed to the anode containing compartment.

6. A method as claimed in claim 1 in which the specific gravity of the anolyte is chosen to be substantially the same as that in the adjacent electrolyte compartment.

7. A method as claimed in claim 1 in which the anolyte is a sulphuric acid solution.

8. A method as claimed in claim 1 in which the diaphragm defining the anode containing compartment is unglazed clay tiles or sheet.

9. A method as claimed in claim 1 in which the porosity of the porous diaphragm is about 30%.

* * * * *